US005085486A

United States Patent [19]

Johnson

[11] Patent Number: 5,085,486

[45] Date of Patent: Feb. 4, 1992

[54] TABLE AND ROCKING APPARATUS

[76] Inventor: Todd L. Johnson, 9670 12th Ave. S., Bloomington, Minn. 55425

[21] Appl. No.: 694,780

[22] Filed: May 2, 1991

[51] Int. Cl.[5] ..... A47C 13/00

[52] U.S. Cl. ..... 297/3; 297/157; 297/183; 297/188; 297/247; 297/258

[58] Field of Search ..... 297/3, 247, 270, 258, 297/257, 183, 188, 283, DIG. 7; 272/56

[56] References Cited

U.S. PATENT DOCUMENTS 4,241,949 12/1980 Parker ..... 297/3

4,783,118 11/1988 Ryan et al. ..... 297/3

FOREIGN PATENT DOCUMENTS 2719761 11/1978 Fed. Rep. of Germany ..... 297/3

OTHER PUBLICATIONS

"Creative Playthings, Inc." catalog, p. 3, 11/22/1963.

"Plywood Rocker-Table" from Popular Science, Jul. 1970.

*Primary Examiner*—Laurie K. Cranmer

*Attorney, Agent, or Firm*—Leon Gilden

[57] ABSTRACT

A structure wherein a plurality of side walls each include a central plate and a "C" shaped leg extending from a rear and forward portion of each side plate to provide for support of the organization in use of the table, with a planar table top directed between the side walls and the organization utilized as a rocking member when the structure is inverted. The organization may be further positioned onto either side wall for use as a support for a drinking organization mounting a container and cup members within recesses.

3 Claims, 4 Drawing Sheets

TABLE AND ROCKING APPARATUS

BACKGROUND OF THE INVENTION

1. Field of the Invention

The field of invention relates to furniture structure, and more particularly pertains to a new and improved table and rocking apparatus wherein the same is used alternatively as a table, rocking structure, or support stand.

2. Description of the Prior Art

Children's amusement and entertainment devices are utilized in the prior art to entertain and amuse children in play. Such devices may be found in the prior art and exemplified in U.S. Pat. No. 3,730,522 to Paczkowski wherein a children's rocking and climbing toy is provided formed as a semi-cylindrical member and a planar surface directed diametrically directed across the cylinder to permit inverting of the structure.

U.S. Pat. No. 3,096,120 to Campbell sets forth a rocking toy arranged of a semi-cylindrical configuration mounting a child and the like at each end thereof. Similarly, U.S. Pat. No. 3,044,773 to Cox sets forth a similar rocker structure of a unitary construction.

U.S. Pat. No. 3,041,070 to Kerstein sets forth a semi-spherical rocking device wherein a plurality of individuals are seated therewithin.

As such, it may be appreciated that there continues to be a need for a new and improved table and rocking apparatus as set forth by the instant invention which addresses both the problems of ease of use as well as effectiveness in accommodating multi-use of the organization as a table, rocking structure, and support stand apparatus.

SUMMARY OF THE INVENTION

In view of the foregoing disadvantages inherent in the known types of rocking apparatus now present in the prior art, the present invention provides a table and rocking apparatus wherein the same utilizes a multi-position unitary structure for use as a table, rocking organization, and support stand. As such, the general purpose of the present invention, which will be described subsequently in greater detail, is to provide a new and improved table and rocking apparatus which has all the advantages of the prior art rocking apparatus and none of the disadvantages.

To attain this, the present invention provides a structure wherein a plurality of side walls each include a central plate and a "C" shaped leg extending from a rear and forward portion of each side plate to provide for support of the organization in use of the table, with a planar table top directed between the side walls and the organization utilized as a rocking member when the structure is inverted. The organization may be further positioned onto either side wall for use as a support for a drinking organization mounting a container and cup members within recesses.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved table and rocking apparatus which has all the advantages of the prior art rocking apparatus and none of the disadvantages.

It is another object of the present invention to provide a new and improved table and rocking apparatus which may be easily and efficiently manufactured and marketed.

It is a further object of the present invention to provide a new and improved table and rocking apparatus which is of a durable and reliable construction.

An even further object of the present invention is to provide a new and improved table and rocking apparatus which is susceptible of a low cost of manufacture with regard to both materials and labor, and which accordingly is then susceptible of low prices of sale to the consuming public, thereby making such table and rocking apparatus economically available to the buying public.

Still yet another object of the present invention is to provide a new and improved table and rocking apparatus which provides in the apparatuses and methods of the prior art some of the advantages thereof, while simultaneously overcoming some of the disadvantages normally associated therewith.

Still another object of the present invention is to provide a new and improved table and rocking apparatus wherein the same permits the seating of one, two, or three individuals selectively on the organization for uses as a rocking structure, and further permitting the organization to be positioned in a stable relationship for use as a support stand and yet further permit positioning of the structure for use as a table structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
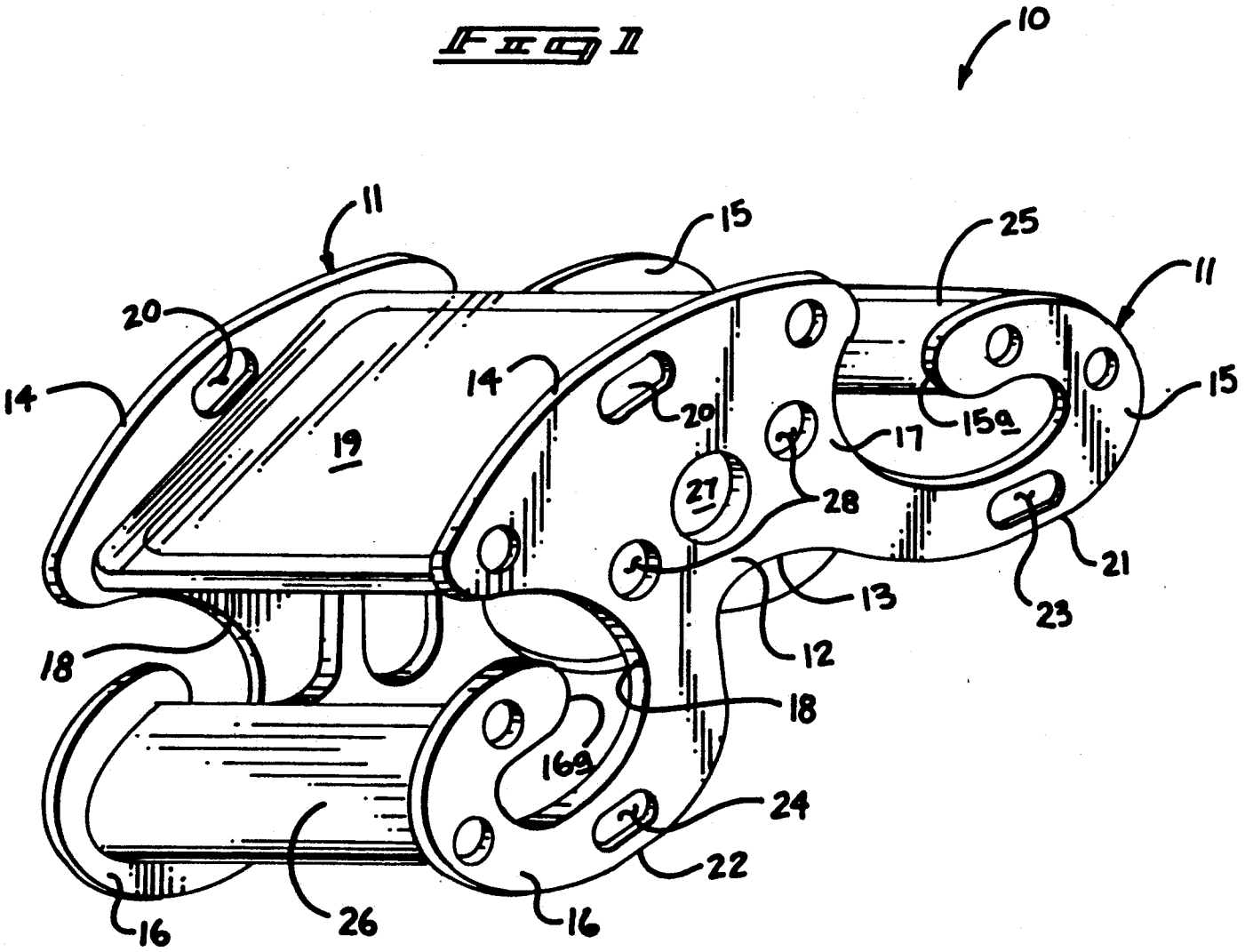
FIG. 1 is an isometric illustration of the instant invention.

With reference now to the drawings, and in particular to FIGS. 1 to 7 thereof, a new and improved table and rocking apparatus embodying the principles and concepts of the present invention and generally designated by the reference numeral 10 will be described.

More specifically, the table and rocking apparatus 10 of the instant invention essentially comprises a plurality of side walls 11, wherein the side walls 11 are of an identical and mirror image configuration spaced parallel and coextensively relative to one another. Each of the side walls 11 includes a central plate 12, with the central plate including a bottom "C" shaped concave edge, with the top edge defined by a top arcuate convex edge 14 spaced from the concave bottom edge 13. The central plate 12 includes side edges defined by a rear "C" shaped central plate side edge 17 of a concave configuration, and a forward "C" shaped central plate side edge 18 of a concave configuration. A rear "C" shaped leg 15 extends laterally of the central plate 12 and terminates in a rear "C" shaped leg end surface 15*a* positioned medially of the rear "C" shaped central plate side edge 17. The forward "C" shaped leg 16 extends laterally of the central plate 12 and then forms a curvilinear member to direct back to wherein a forward "C" shaped end surface 16*a* is positioned medially and in confronting relationship relative to the forward "C" shaped central plate side edge 18. A table plate 19 is orthogonally mounted between interior surfaces of the spaced side walls 11, and includes a planar top surface and bottom surface and is spaced below first hand grip openings 20 positioned adjacent each top arcuate convex edge 14 of each side wall 11. The rear "C" shaped leg 15 includes a rear "C" shaped leg arcuate bottom surface 21, and the forward "C" shaped leg 16 includes a forward "C" shaped leg arcuate bottom surface 22, wherein the rear and forward bottom surfaces 21 and 22 are aligned relative to one another to provide a support surface when the organization is used as a table and mounted upon the bottom surfaces 21 and 22 of each of the side walls 11.

Figure 2:
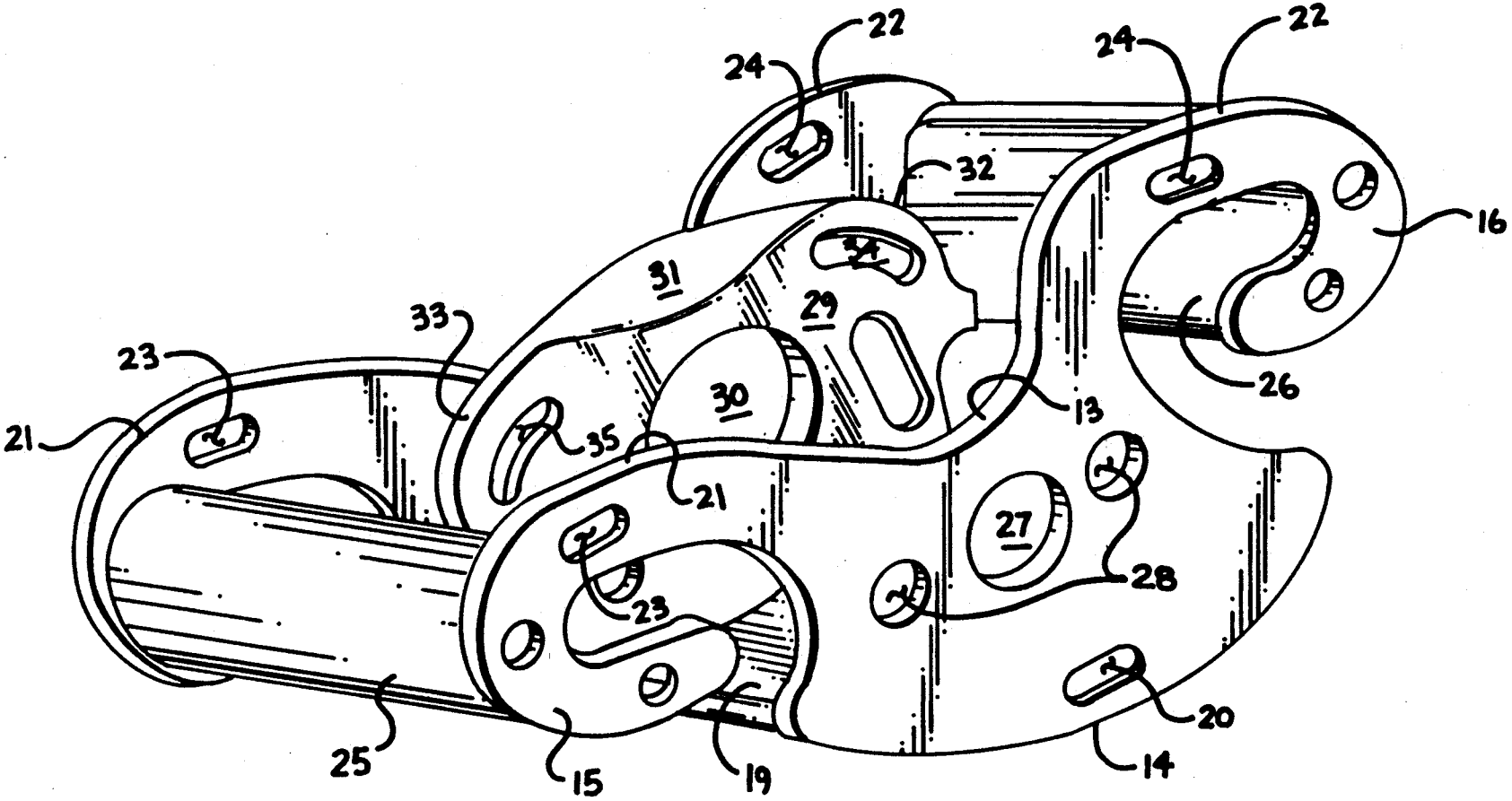
FIG. 2 is an isometric illustration of the instant invention in an inverted configuration.
Figure 3:
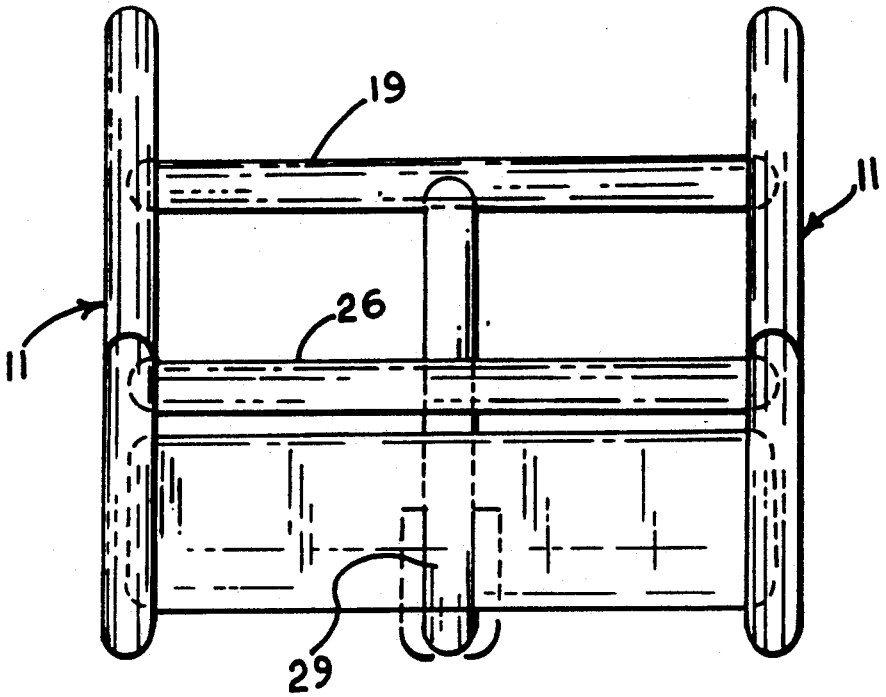
FIG. 3 is an orthographic end view of the instant invention.
Figure 4:
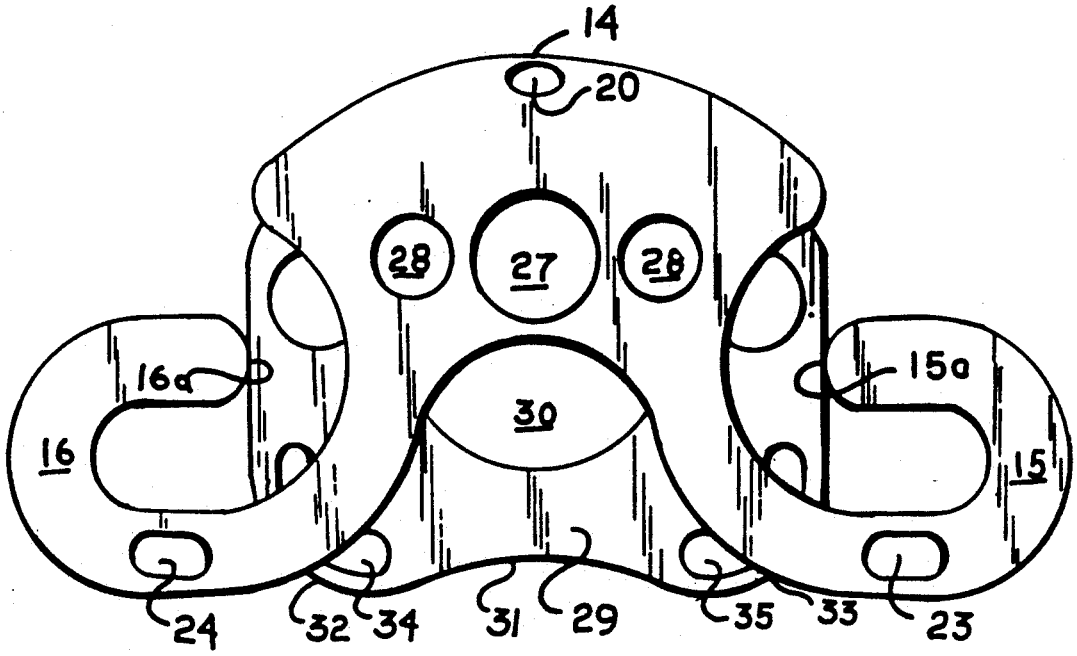
FIG. 4 is an orthographic side view of the instant invention.

When the organization is in an inverted configuration as illustrated in FIG. 2 for example, the organization is rockably or pivotally supported by the top arcuate convex edges 14 of each of the side walls 11. In this manner, the rear "C" shaped legs 15 include second handle openings 23 directed therethrough adjacent the rear "C" shaped leg arcuate bottom surfaces 21, while the forward "C" shaped legs 16 include third handle openings 24 directed through the forward "C" shaped legs 16 adjacent the forward "C" shaped leg arcuate bottom surfaces 22 to provide handle structures for individuals seated upon the respective rear and forward seat plates 25 and 26 that are orthogonally mounted between the rear and forward "C" shaped legs 15 and 16 respectively. These "C" plates are utilized for a plurality of individuals in use of the organization as a rocking structure. Further, a central seat flange 29 is fixedly and orthogonally mounted to the bottom surface of the table plate 19 and extends medially and parallel between the side walls 11 and orthogonally relative to the rear and forward seat plates 25 and 26 and includes a concave flange top surface 31, with spaced convex forward and rear edge surfaces 32 and 33 positioned adjacent the concave flange top surface 32 and 33. The respective concave forward and rear edge surfaces 32 and 33 include respective fourth and fifth handle openings 34 and 35 directed through the seat flange 29 adjacent the aforenoted convex forward and rear edge surfaces 32 and 33 to provide handle securement means for an individual seated upon the concave flange top surface 31. In this manner, a single individual may be seated upon the seat flange 29, either in concert with or a plurality of individuals mounted upon the rear and forward seat plates 25 and 26, or in a solitary manner to effect rocking of the structure.

Figure 5:
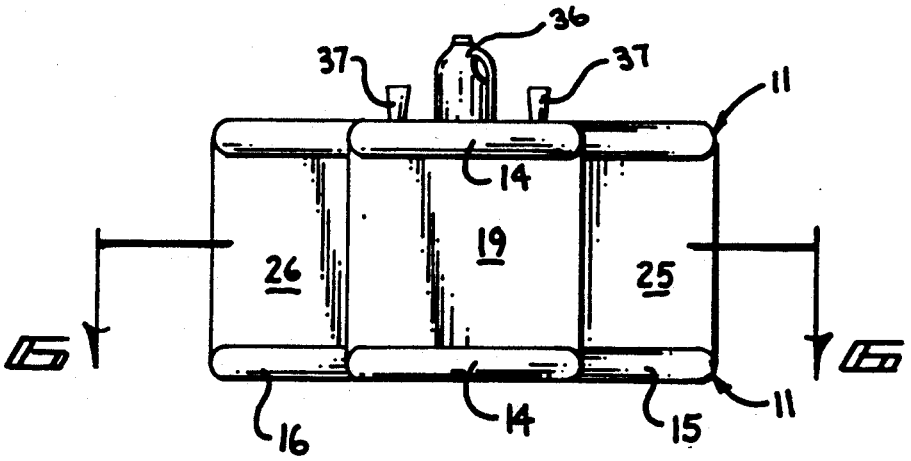
FIG. 5 is an orthographic top view of the instant invention.

It should be further noted that the side walls 11 each include a first cylindrical cavity 27 orthogonally directed into each side wall, with a plurality of second cavities 28 positioned adjacent the first cavity, wherein the first cavity is of a first diameter and the second cavities are of a second diameter less than the first diameter, wherein (see FIG. 5) a first container 36 containing a predetermined liquid such as lemonade and the like is positioned within the first cavity 27 and a plurality of cup members 37 are positioned within the second cavities 28 when the organization is supported upon one of the side walls 11, in a manner as illustrated in FIG. 5.

Figure 6:
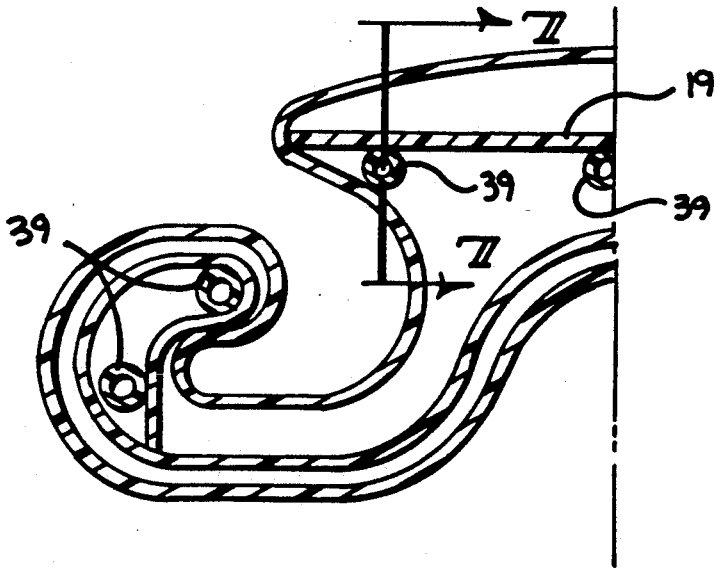
FIG. 6 is an orthographic view, taken along the lines 6—6 of FIG. 5 in the direction indicated by the arrows.
Figure 7:
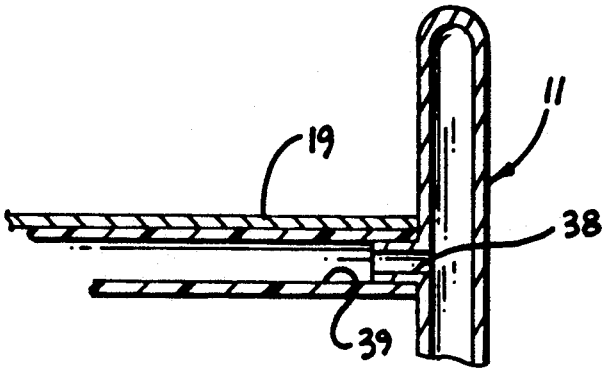
FIG. 7 is an orthographic view, taken along the lines 7—7 of FIG. 6 in the direction indicated by the arrows.

The structure may be assembled in any manner as desired to provide a unitary integral structure, but may optionally utilize two projections 38 receivable within projection receiving tubes 39 for assembling the side walls to the table plate 19, as well as to the rear and forward seat plates 25 and 26, as illustrated in FIGS. 6 and 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A table and rocking apparatus comprising, in combination, a plurality of spaced parallel side walls, each of a mirror image and coextensive configuration relative to one another, with each side wall including a top arcuate convex edge and a central plate orthogonally and fixedly mounted between the side walls adjacent the top arcuate convex edge, and a first hand grip opening directed through each side wall between each top arcuate convex edge and a top surface of the central plate, and each side wall further including a rear "C" shaped leg extending laterally and rearwardly of the central plate and a forward "C" shaped leg extending laterally and forwardly of the central plate, wherein the rear and forward "C" shaped leg of each side wall includes a respective rear and forward "C" shaped arcuate bottom surface to accommodate support of the apparatus in a first position, wherein the top arcuate convex edge of each side wall supports the apparatus in an inverted second position, and wherein each central plate includes a rear "C" shaped central plate side edge and a forward "C" shaped central plate side edge spaced on opposed sides of each central plate, wherein the rear "C" shaped leg of each side wall includes a rear "C" shaped leg end surface projecting medially and adjacent the rear "C" shaped central plate side edge, and each forward "C" shaped leg includes a forward "C" shaped leg end surface projecting medially and adjacent the forward "C" shaped central plate side edge, and a rear seat plate orthogonally and fixedly mounted between each rear "C" shaped leg adjacent the rear "C" shaped leg end surface of each rear "C" shaped leg, and a forward seat plate orthogonally and fixedly mounted between each forward "C" shaped leg adjacent each forward "C" shaped leg end surface of each forward "C" shaped leg, and each rear "C" shaped leg includes a second handle opening opening directed therethrough adjacent the rear "C" shaped leg arcuate bottom surface of each rear "C" shaped leg, and each forward "C" shaped leg includes a third handle opening directed therethrough adjacent each forward "C" shaped leg arcuate bottom surface, and including a seat flange fixedly and orthogonally mounted to a bottom surface of the central plate oriented medially and parallel to the side walls and further oriented orthogonally relative to the rear and forward seat plates and positioned medially of the rear and forward seat plates, wherein the seat flange includes a concave flange top surface to accommodate an individual seated thereon.

2. An apparatus as set forth in claim 1 wherein the seat flange further includes a convex rear edge surface adjacent the concave flange top surface, and a convex forward edge surface adjacent the convex flange top surface, wherein the convex rear and forward edge surfaces each include a respective fifth and fourth handle opening directed through the seat flange adjacent the respective rear and forward edge surfaces to permit manual grasping of the seat flange during a rocking event when the apparatus is in the second position.

3. An apparatus as set forth in claim 2 wherein each central plate includes a first cylindrical cavity defined by a first diameter, and a plurality of second cylindrical cavities of a second diameter less than the first diameter, and a first container selectively and removably mounted within the first cavity and a plurality of cup members selectively and removably mounted within the second cavities when the apparatus is in a third position supported by one of said side walls.

* * * * *